US006065981A

United States Patent [19]

Sopotnick et al.

[11] Patent Number: 6,065,981

[45] Date of Patent: May 23, 2000

[54] MARINE POWER CORD COVER

[76] Inventors: David F. Sopotnick; Nancy S. Sopotnick, both of 3866 Cardinal Blvd., Daytona Beach, Fla. 32127

[21] Appl. No.: 09/017,956

[22] Filed: Feb. 3, 1998

[51] Int. Cl.[7] ..... H01R 13/44

[52] U.S. Cl. ..... 439/135

[58] Field of Search ..... 439/135, 148, 439/149, 220

[56] References Cited

U.S. PATENT DOCUMENTS 5,588,853 12/1996 Anthony ..... 439/136

*Primary Examiner*—Lincoln Donovan

*Assistant Examiner*—Chandrika Prasad

*Attorney, Agent, or Firm*—Hedman, Gibson & Costigan, P.C.

[57] ABSTRACT

A marine power cord cover having a cap for providing sealing engagement with the terminal end of the power cord, a tab to facilitate removal of the cap from the terminal end of the power cord and a tether to the power cord to maintain the cover in proximity thereto. The cover is preferably made of a unitary oil resistant thermoplastic material.

6 Claims, 3 Drawing Sheets

MARINE POWER CORD COVER

FIELD OF THE INVENTION

The present invention relates to a cover for the end of a marine power cord.

BACKGROUND OF THE INVENTION

Although larger boats generally have their own power generator, to be able to use electrical appliances at sea, electrical power is provided at the dock via a 30 or 50 amp power cord. However, the power cord is prone to becoming wet and inevitably oxidizing due to the proximity to water, especially near salt water. Additionally, a wet cord cannot be used for fear of electrical shock or short.

Due to these problems, many boaters have taken to covering the ends of their power cords by placing a plastic bag over the terminal end and placing a rubber band or twist-tie around the end of the bag, down upon the wire of the cord. Although this performs the necessary function, a bag is not always handy and is not quickly and easily installed and removed.

SUMMARY OF THE INVENTION

The present invention overcomes the deficiencies of the prior art with a cover for marine power cords comprising a cap portion having engagement means for engaging a terminal end of the power cord, tab means on said cap portion for facilitating removal of the cap portion from the terminal end of the power cord and retention means for maintaining the cap portion in proximity to the power cord.

Preferably, the cover of the present invention is formed from an oil resistant thermoplastic material. The engagement means of the cap portion is preferably formed to provide a weather seal between the cap and the terminal end of the power cord.

Depending on the dimensions, the cover of the present invention is intended to be used on standard 30 and 50 amp marine power cords.

BRIEF DESCRIPTION OF THE DRAWINGS

The attached drawings, in which like reference characters indicate like parts, are intended to illustrate the invention without limiting the invention in any manner whatsoever.

DETAILED DESCRIPTION OF THE PREFERRED EMBODIMENT

Figure 1:
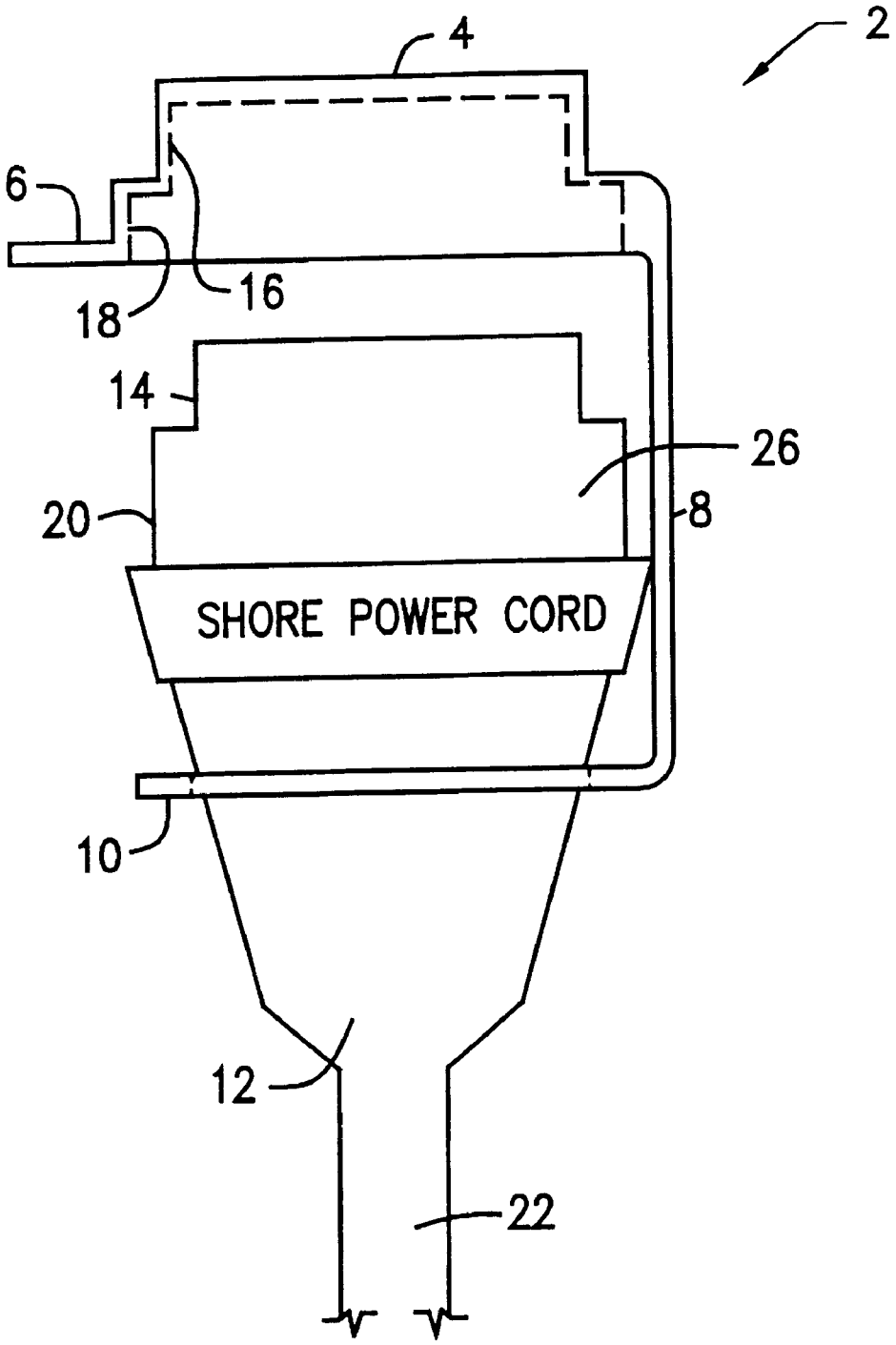
FIG. 1 is a schematic elevational view of the power cord cover of the present invention.

In its preferred embodiment the marine power cord cover 2 of the present invention has a cap 4, for enclosing the end of the power cord 12, with a tab 6 for facilitating removal of the cap 4. The cover 2 also includes retention means comprising a tether 8 and ring 10 for maintaining the cover in proximity to a marine or shore power cord 12, as shown in FIG. 1.

The cap 4 preferably includes a downwardly depending wall 16 to engage the circular male terminal end 14 of the power cord 12 with a friction fit to form a seal therebetween. The interior depth of the sealing wall 16 should be at least enough to allow the cap 4 to fully extend over the terminal end 14 of the cord 12. A depth of about 1" has been found to be suitable for both 30 and 50 amp power cord applications. The seal between the downwardly depending sealing wall 16 and the male terminal end 14 is intended to protect the contacts within the male terminal end 14 of the power cord 12 from water, weather and salt air which cause oxidation and degradation of the contacts.

Figure 2:
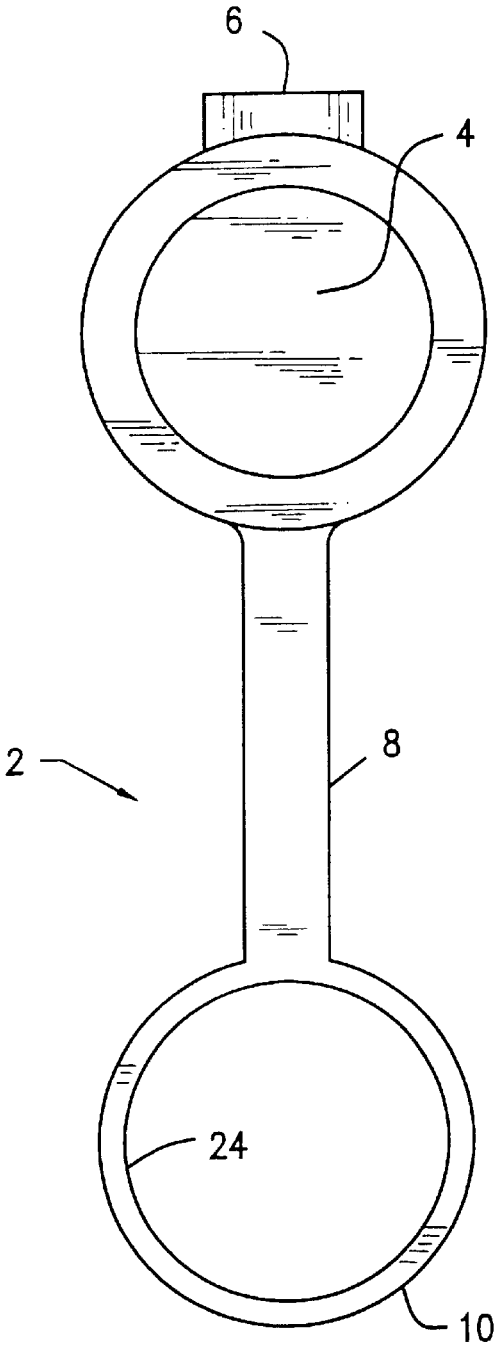
FIG. 2 is a top plan view of the power cord cover of the present invention.
Figure 3:
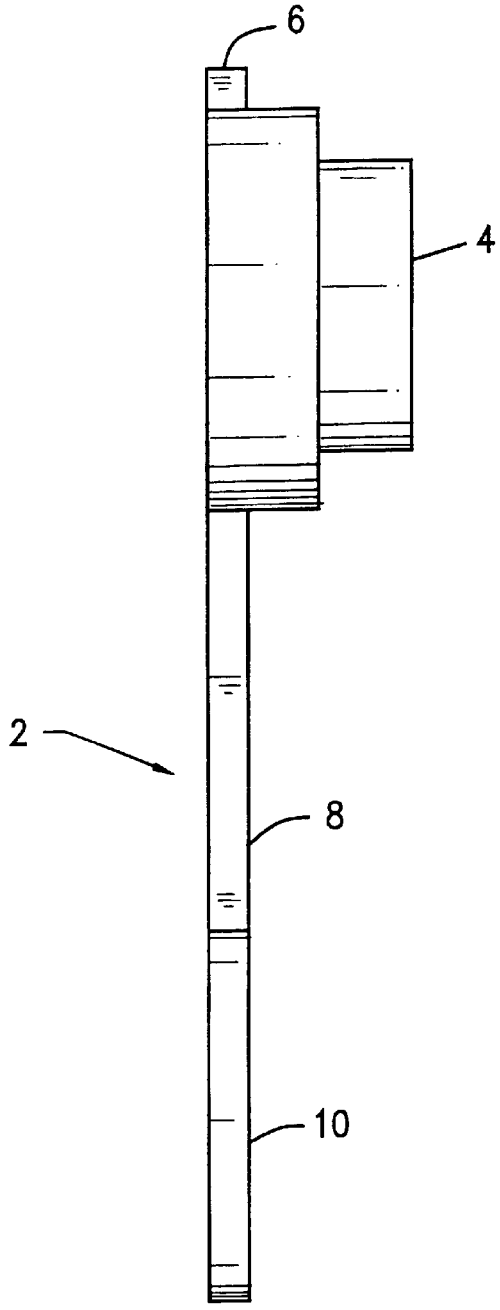
FIG. 3 is a side elevational view of the power cord cover of the present invention.

In its most preferred embodiment, shown in FIGS. 1–3, the cover 2 has a second downwardly depending wall 18 of greater diameter than the first downwardly depending wall 16 to provide a friction fit seal with a second, larger diameter step 20 near the terminal end 14 on the head 26 of the power cord 12. The second sealing wall 18 further ensures a water resistant seal for protecting the contacts of the power cord 14.

Figure 4:
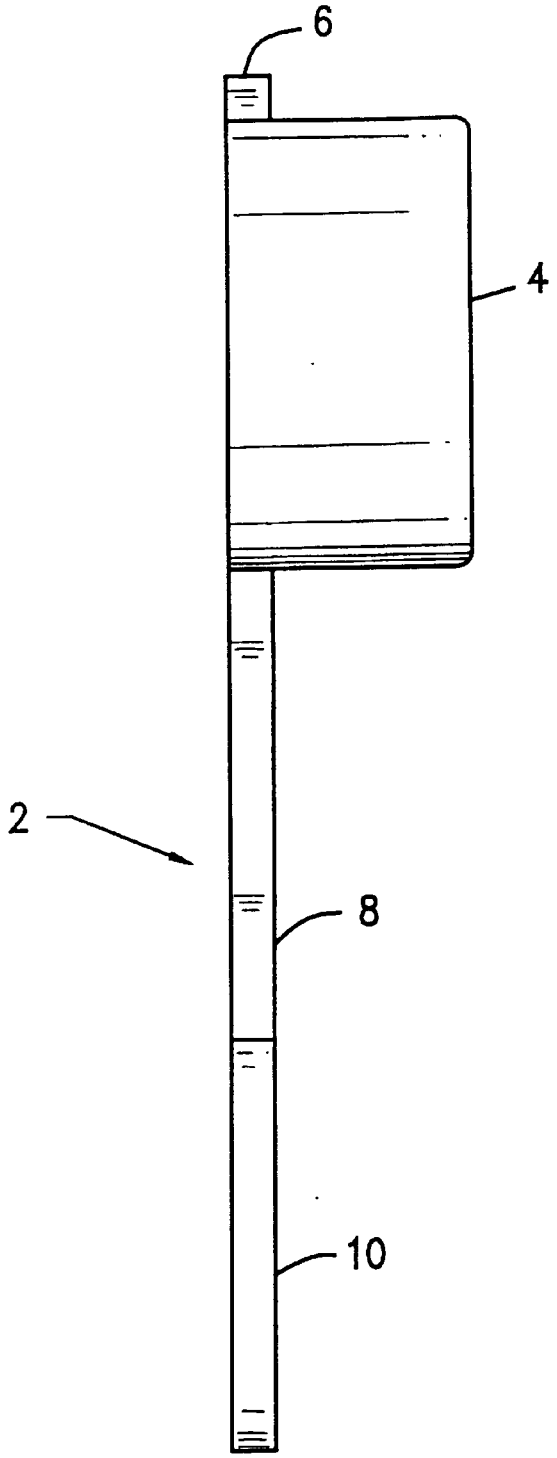
FIG. 4 is a side elevational view of an alternative embodiment of the power cord cover of the present invention.

Of course, the present invention also contemplates as an alternative embodiment a single sealing wall 16. As shown in FIG. 4, the single sealing wall 16 can form a seal with either portion 14 or 20 of the head 26 of the cord 2, depending on which diameter is chosen.

The tab 6 extends from the cap 4 to facilitate removal of the cap 4 from the terminal end 14 of the power cord 12. The size of the tab 6 need only be sufficient to facilitate application of the force necessary to remove the cap 4 from the terminal end 14 of the cord 12.

To ensure that the cover 2 is available when needed it is maintained in proximity to the cord 12 by retention means. Preferably, the retention means comprises attachment means 10 and a tether 8 between the attachment means 10 and the cap 4.

The attachment means 10 is preferably a ring or the like with an internal diameter 24 greater than the wire 22 but less than the head 26 of the power cord 12. Of course, other attachment means such as clips, split rings, clasps, alligator ties, velcro straps, snaps and the like can be used on the attachment means 10, however, most preferred is the unitary ring as shown in the FIGURES.

It is also preferred that the tether 8 is of unitary construction with the cap 4 and the attachment means 10. The tether 8 should be of sufficient width and thickness to withstand normal stresses and strains which are contemplated with the use of the cover 2. Similarly, the tether 8 should be of sufficient length to allow easy application of the cap 4 to the terminal end 14 of the cord 12. Of course, the tether 8 can be any appropriate strong, flexible material, including string (preferably nylon), chain, wire or the like connected by any known means between the cap 4 and the attachment means 10.

In its most preferred embodiment the cover 2 is formed of a unitary thermoplastic material. Preferably the thermoplastic is chosen to be a flexible oil resistant thermoplastic material that will avoid degradation from gasoline and oils normally present at a dock environment.

Obvious variations of the above will occur to those skilled in the art. All such variations are intended to fall within the spirit and scope of the present invention, defined only by the appended claims.

We claim:

1. A cover for a marine power cord, the power cord terminal end having a small diameter body portion extending from a large diameter body portion, comprising a cap portion, said cap portion being hollow and having an open end, having a first downwardly depending sealing surface for friction fit over the small diameter body portion of the terminal end of the power cord and a second downwardly depending sealing surface of a larger diameter than said first sealing surface for friction fit over the large diameter body portion of the terminal end of the power cord, the second sealing surface being at the open end of the cap portion, for sealing a terminal end of the power cord, a tab on said cap portion for facilitating removal of said cap portion from the terminal end of the power cord and retention means for maintaining the cap portion in proximity to the power cord.

2. The cover of claim 1 wherein the tab is on a side of the cap portion opposed to the side with which the retention means is associated.

3. The cover of claim 1 wherein the retention means comprises attachment means for attaching the cover to a power cord and a tether between the attachment means and the cap portion.

4. The cover of claim 3 wherein the attachment means comprises a ring having a diameter greater than the wire of the power cord but less than the terminal end of the power cord.

5. The cover of claim 1 wherein the cover is formed of an oil resistant thermoplastic material.

6. The cover of claim 5 wherein the cover is formed of unitary construction.

* * * * *